US007982442B2

(12) United States Patent
Solyom et al.

(10) Patent No.: US 7,982,442 B2
(45) Date of Patent: Jul. 19, 2011

(54) POWER SYSTEM

(75) Inventors: Stefan Solyom, Göteborg (SE); Bo Lincoln, Lund (SE); Anders Rantzer, Lund (SE)

(73) Assignee: ABB Technology Ltd., Zürich (CH)

( * ) Notice: Subject to any disclaimer, the term of this patent is extended or adjusted under 35 U.S.C. 154(b) by 642 days.

(21) Appl. No.: 10/589,197

(22) PCT Filed: Feb. 11, 2005

(86) PCT No.: PCT/SE2005/000192

§ 371 (c)(1),
(2), (4) Date: Sep. 10, 2007

(87) PCT Pub. No.: WO2005/078546

PCT Pub. Date: Aug. 25, 2005

(65) Prior Publication Data

US 2008/0122414 A1 May 29, 2008

(30) Foreign Application Priority Data

Feb. 11, 2004 (SE) ..... 0400301

(51) Int. Cl.
*G05F 1/14* (2006.01)
*G05F 1/20* (2006.01)
*H01F 29/04* (2006.01)

(52) U.S. Cl. ..... 323/247; 323/255; 323/340; 323/356

(58) Field of Classification Search ..... 323/247, 323/255–258, 260, 263–264, 328, 340–341, 323/343, 356
See application file for complete search history.

(56) References Cited

U.S. PATENT DOCUMENTS

| | | | | |
|---|---|---|---|---|
| 2,753,512 | A * | 7/1956 | Helterline, Jr. et al. | 323/263 |
| 3,351,848 | A * | 11/1967 | Lodder | 323/222 |
| 3,507,096 | A * | 4/1970 | Hall et al. | 96/21 |
| 4,434,388 | A * | 2/1984 | Carver et al. | 315/307 |
| 4,560,917 | A * | 12/1985 | Gyugyi | 323/210 |
| 5,627,735 | A * | 5/1997 | Bjorklund et al. | 363/35 |
| 6,219,591 | B1 | 4/2001 | Vu et al. | |
| 6,313,614 | B1 | 11/2001 | Persson et al. | |
| 2006/0022648 | A1 * | 2/2006 | Ben-Yaakov et al. | 323/222 |

* cited by examiner

*Primary Examiner* — Adolf Berhane
*Assistant Examiner* — Nusrat J Quddus
(74) *Attorney, Agent, or Firm* — Venable LLP; Eric J. Franklin

(57) ABSTRACT

A method for voltage stabilization of an electrical power network system including a producing power network system side, a consuming power network side including a power load, a power transmission line with an impedance $Z_{LN}$, a transformer and an on-line tap changer added to the transformer. The impedance of the line is measured in case of dynamic instabilities. A transformer ratio n is controlled by changing a voltage reference $V_{ref}$ of the on-line tap changer. The voltage reference is changed according to a feed forward compensation from the impedance of the line.

4 Claims, 8 Drawing Sheets

**Two-node system with generator, transmission line, transformer and load. Dynamic compensation of the reference voltage is introduced through the blocks *FF* and *FB*.**

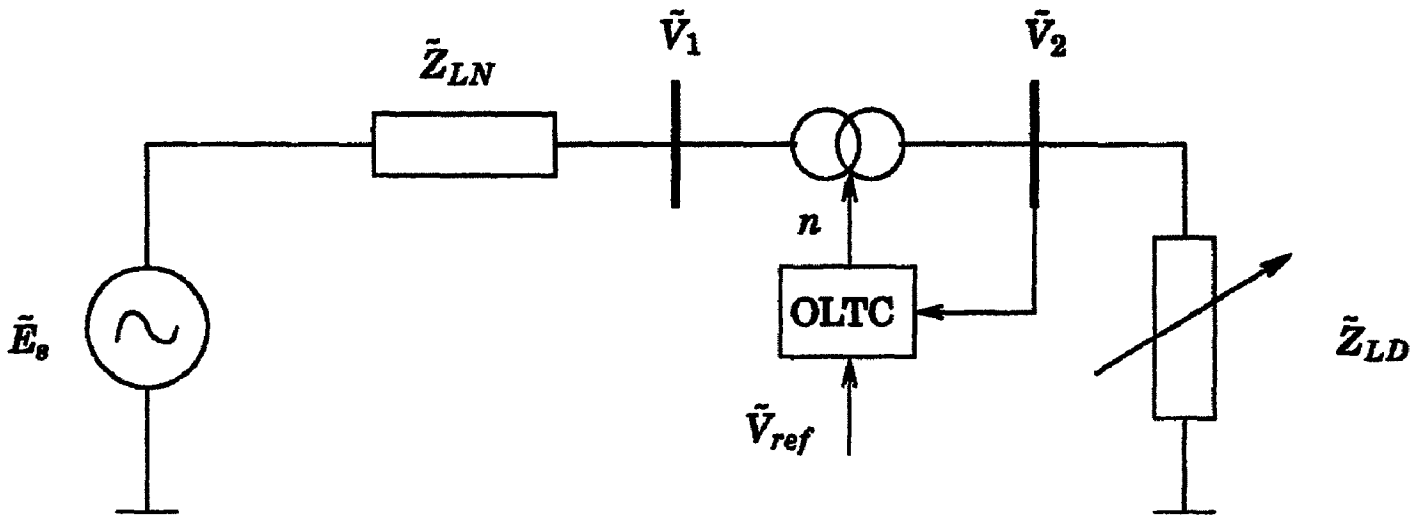
Figure 1: Two-node system with generator, transmission line, transformer and load.
Prior Art

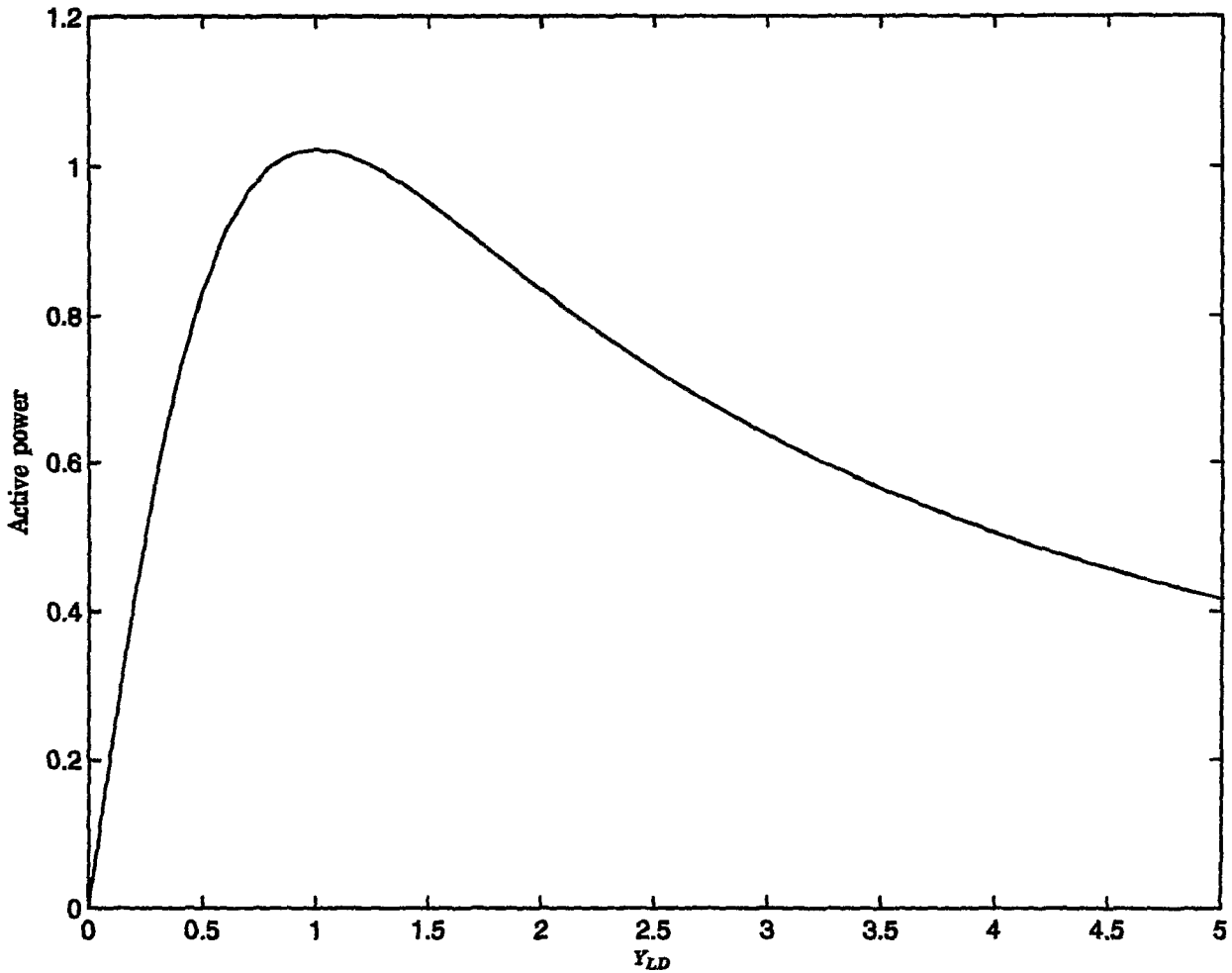
Figure 2: Active power with respect to load impedance. For a particular impedance the transfered active power reaches a maximum.

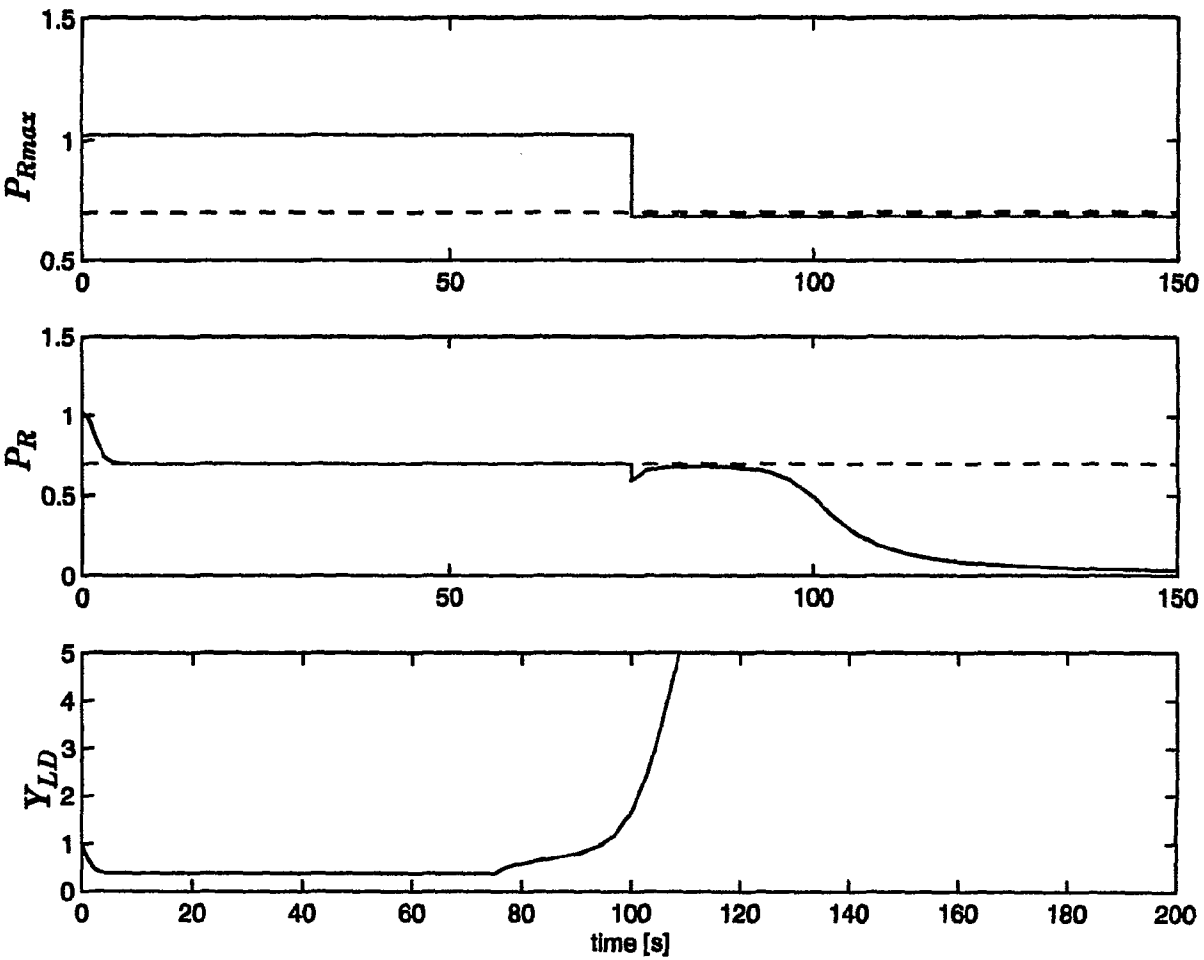
Figure 3: Instability in a two node system with recovery mechanism in the load. A fault is simulated at $t$=75 by increasing the line impedance. The load is trying to achieve the desired active power 0.7 (dashed line) by decreasing its impedance. Since the maximum achievable active power is just below 0.7, the system becomes unstable and will increase to infinity.

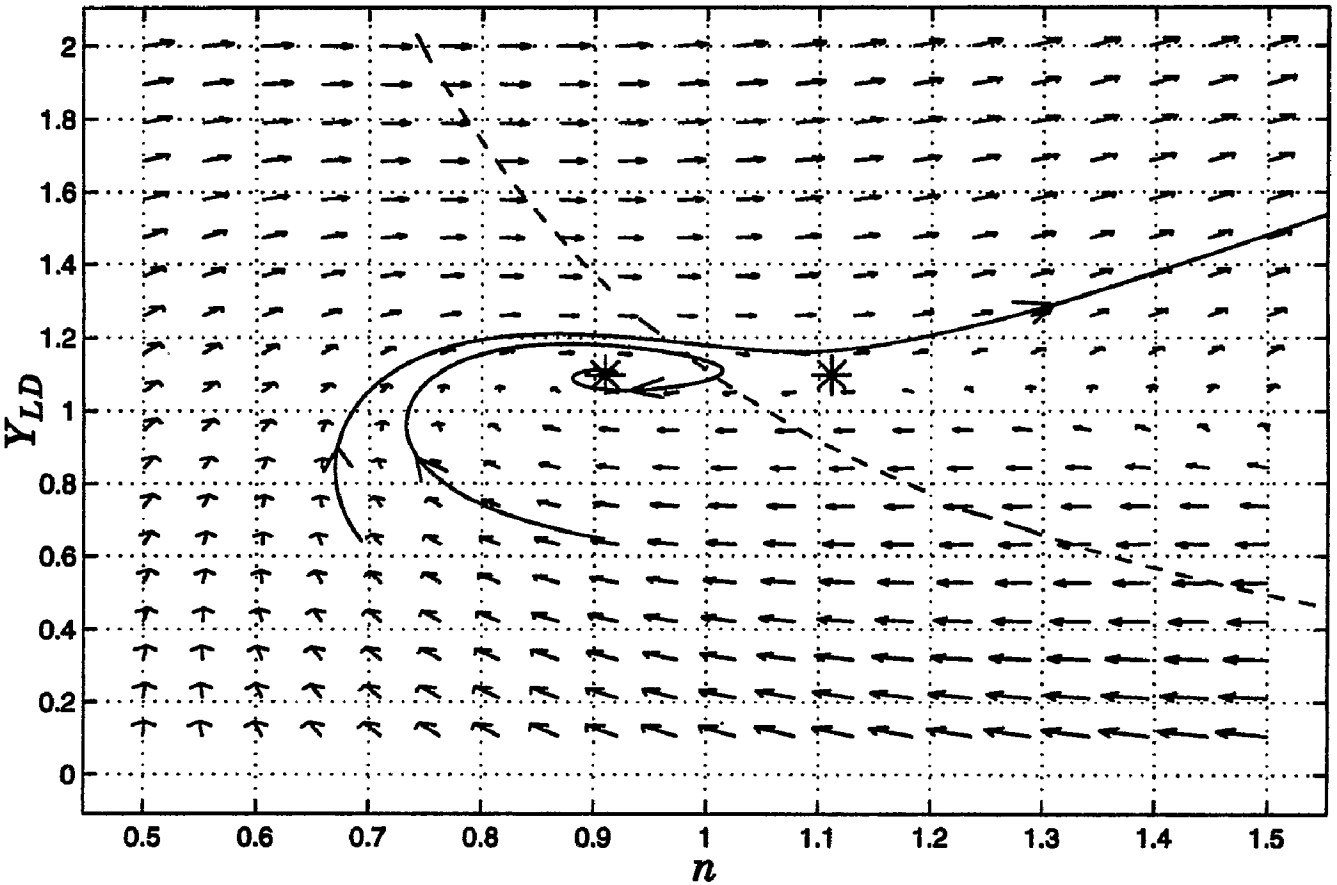
Figure 4: Vector field for the design model consisting of eqs. (1) and (2). The asterisks mark the two equilibrium points. The dashed curve is the loci for maximum power transfer, .

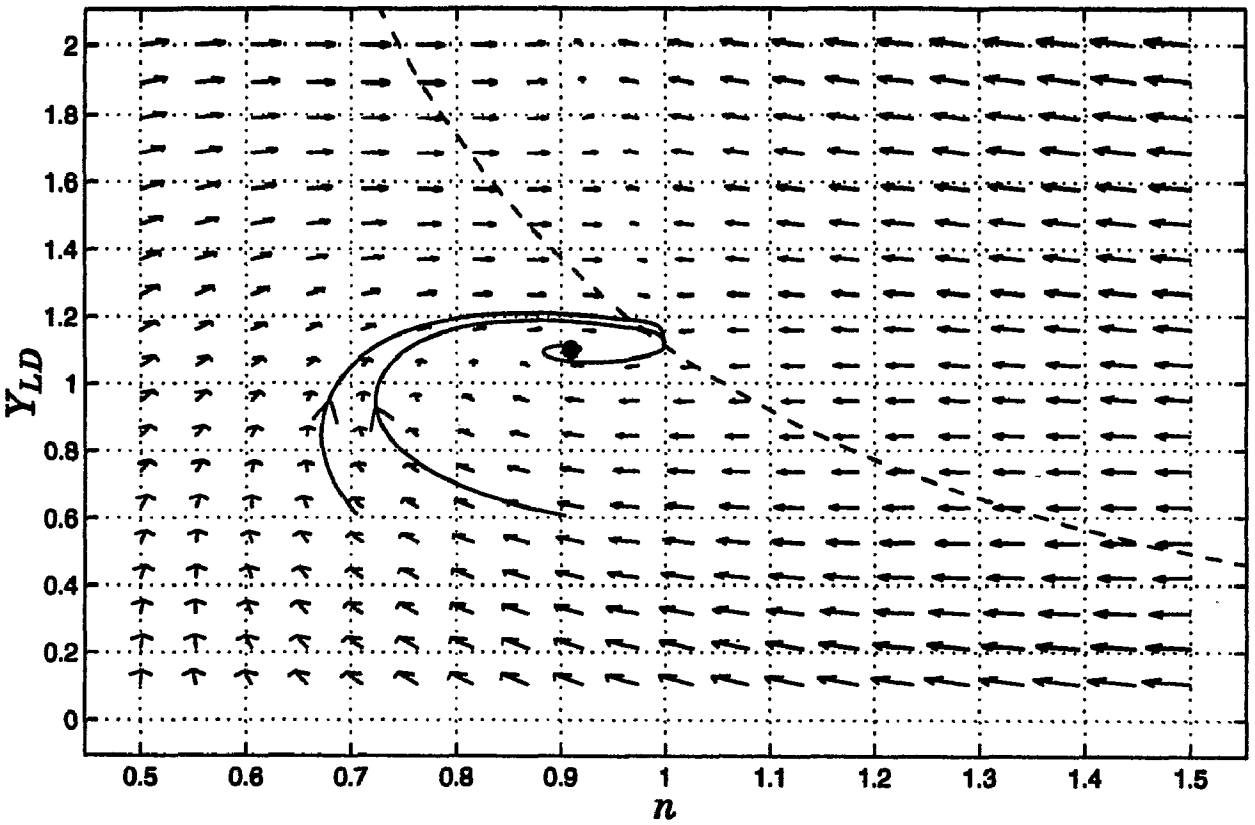
Figure 5: Vector field for the design model consisting of eqs. (1) and (2) with compensation. The dot marks the stable equilibrium point. The dashed curve is the loci for maximum power transfer, .

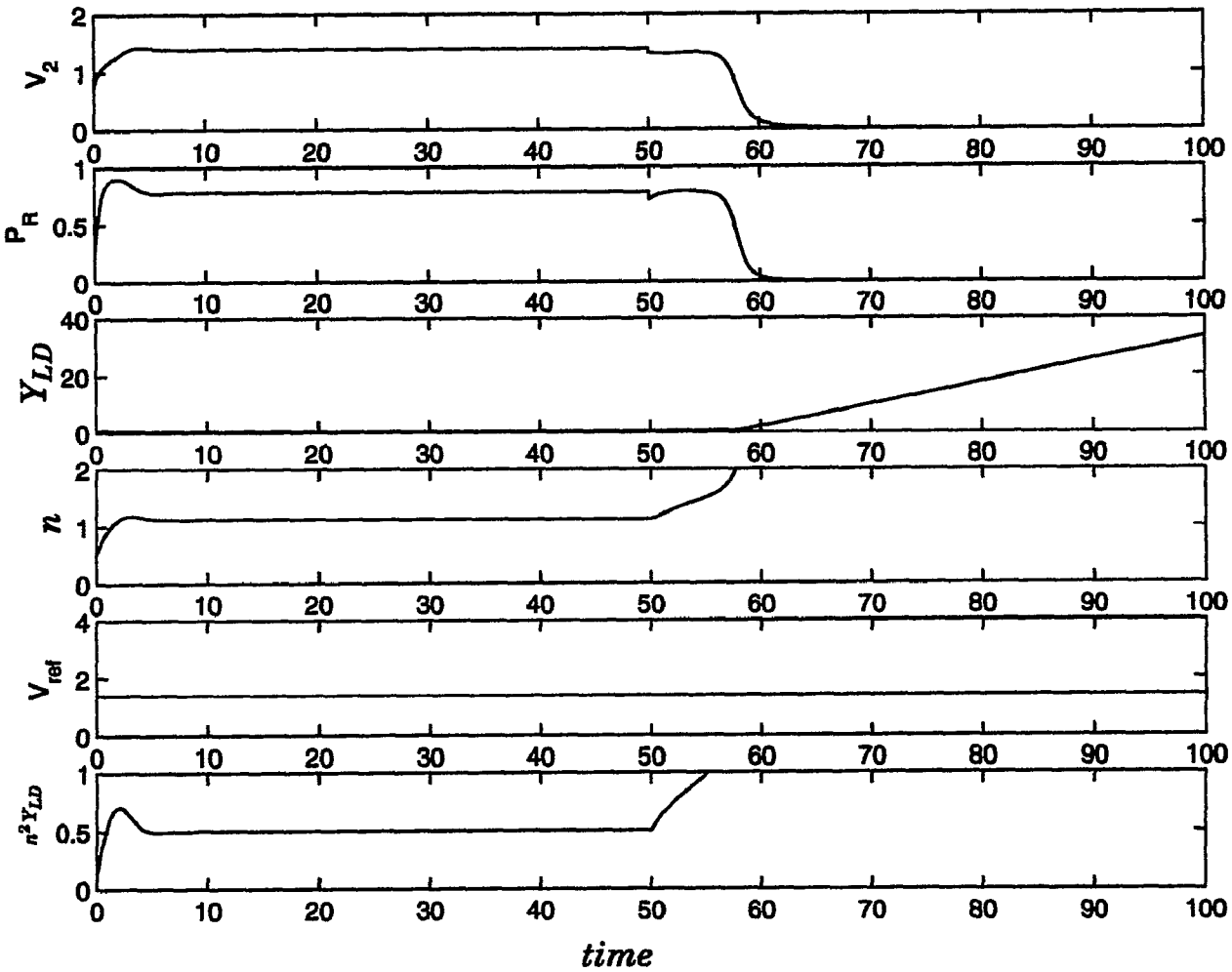
Figure 6: Due to a step change in , the nonlinearity $f$ changes such that the stable equilibrium point is very close to the top and due to the overshoot in an excursion over the top of $f$ will occur that leads to instability.

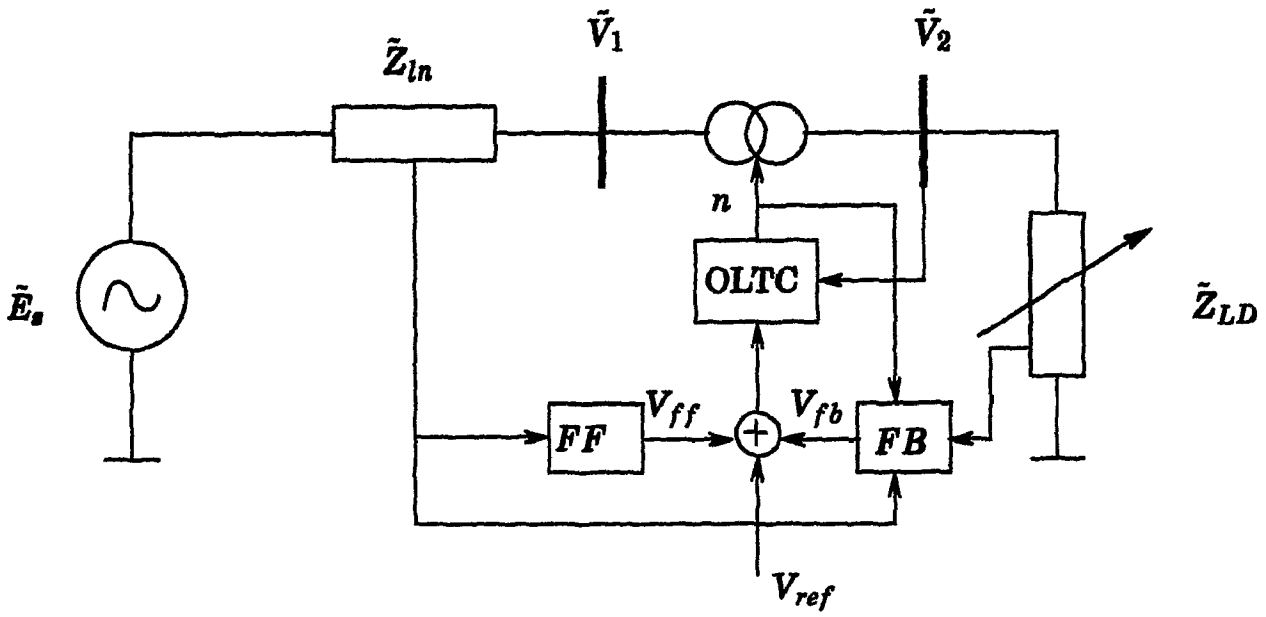
Figure 7: Two-node system with generator, transmission line, transformer and load. Dynamic compensation of the reference voltage is introduced through the blocks *FF* and *FB*.

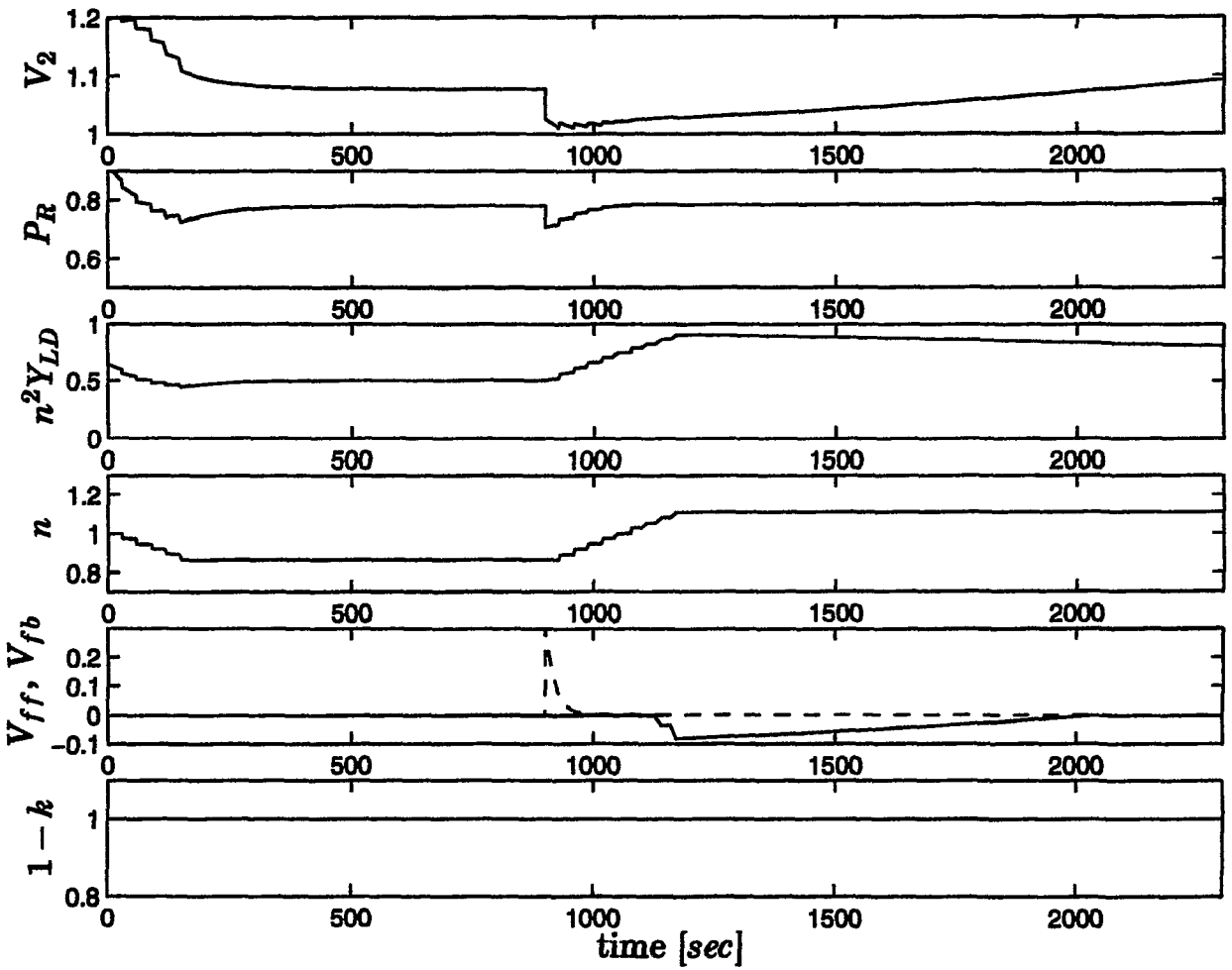
Figure 8: At $t$=800 seconds, a line tripping is simulated by a 20% increase of the line impedance . By momentary changes of the reference value by augmentation with (dashed line) and , stability is maintained without shedding load. In case the reference voltage had been kept constant, the system would become unstable.

POWER SYSTEM

CROSS-REFERENCE TO RELATED APPLICATIONS

This application claims priority to Swedish patent application 0400301-8 filed 11 Feb. 2004 and is the national phase under 35 U.S.C. §371 of PCT/SE2005/000192 filed 11 Feb. 2005.

TECHNICAL FIELD

The present invention relates to a power system and in particular to a method for voltage stabilization of an electrical power network system comprising a producing power network system side and a consuming power network side to maintain voltage.

BACKGROUND OF THE INVENTION

A power system consists of several electrical components (e.g. generators, transmission lines, loads) connected together, its purpose being generation, transfer and usage of electrical power.

In a conventional On-Line Tap Changer (OLTC) the control is given by a simple integrator with a time delay and deadband. The size of the deadband sets the tolerance for long term voltage deviation. The reference signal for the integrator is the secondary voltage setpoint. This is usually kept constant at the desired secondary voltage.

Voltage stability of a power system is defined by the IEEE Power System Engineering Committee as being the ability of the system to maintain voltage such that when load admittance is increased, load power will increase so that both power and voltage are controllable [2].

Voltage stability in power networks is a widely studied problem. Several voltage collapses resulting in system-wide black-outs made this problem of major concern in the power system community.

In todays state-of-the-art practice, the following methods are used to detect that the system is close to voltage instability:

1. As too much power is requested by the load, the generators will start using their rotational energy, implying that the frequency of the voltage (50/60 Hz) will start to decrease. Detecting a low frequency has been a too slow measure to stop the voltage collapse in for example eastern USA in 2003.
2. Another sign of overload is that the load voltage drops. However, it has been shown that neither this is a good measure for the instability of the grid.

Using any of the above methods (or similar), the actions taken by the power companies is usually one or both of the following:

1. Connect capacitor banks, to increase the active effect that can be consumed by the load. If this is done in time, a voltage collapse can sometimes be avoided. A disadvantage of this method is that it makes the network more sensible to load variations.
2. Disconnect certain amounts of load (load shedding). This is a very "expensive" measure, and therefore avoided for as long as possible by the power company. However this measure can prevent the whole power net from collapsing.

This invention is concerned with dynamic stability of a power systems. The inventors propose a dynamic feedback and feed-forward based compensation that aims at stabilization of the power grid. This control structure is intended to function as an emergency control scheme, i.e., it will be active in critical situations when the network is near voltage collapse.

SUMMARY OF THE INVENTION

The considered power system is shown in FIG. 1. It is a radial system containing a generator $E_s$, a transmission line with impedance $\tilde{Z}_{ln}$, a transformer with an on-line tap changer (OLTC) and a load with impedance $\tilde{Z}_{LD}$. The on-line tap changer regulates the voltage on the load side at a desired value $V_{ref}$. The load itself dynamically changes its impedance. Most of the loads are such that they try to absorb a certain amount of power. That implies that when the load voltage drops, the loads will decrease their impedance to keep power constant.

BRIEF DESCRIPTION OF THE DRAWINGS

FIG. 1 represents a block diagram of an embodiment of a power system;

FIG. 2 represents a graph illustrating a relationship between active power and power load impedance;

FIG. 3 represents graphs illustrating relationships between maximum transferable active power, transferred active power and power load impedance and time;

FIG. 4 represents a vector field for an embodiment of a design model according to the invention;

FIG. 5 represents a vector field for an embodiment of a design model according to the invention;

FIG. 6 represents graphs illustrating relationships between voltage on a secondary winding of a transformer, transferred active power, power load impedance, transformer ratio, reference voltage, transformer ratio squared times power load impedance and time;

FIG. 7 represents a block diagram of an embodiment of a compensator according to the invention; and FIG. 8 represents graphs illustrating relationships between voltage on a secondary winding of a transformer, transferred active power, transformer ratio squared times power load impedance, transformer ratio, feedback compensation, feed-forward compensation and load shedding input and time.

DETAILED DESCRIPTION OF EMBODIMENTS OF THE INVENTION

There are two control loops in this system, acting independently of each other.

The On-Line Tap Changer (OLTC) in the transformer, which tries to keep the voltage on the load side constant at the reference value $V_{ref}$.

The load itself can be viewed as a control system, which changes its impedance (or equally admittance) in order to absorb a given power.

The problem is that these two independent control loops can, due to their non-linear interaction, drive the system to voltage instability even if the system could handle the power required by the load.

This work proposes a general method that momentarily changes the behavior of the OLTC when the line and/or load impedance changes such that the system is driven into the critical operation regime.

It is important to again point out that the proposed control structure is meant to operate in case of dynamic instabilities. This means that after a line and/or load impedance change (for example due to a line failure or an increase of power request from the load) the power grid is still statically capable of transferring the load power request.

In particular the method of the invention is characterized in that the power transfer $Y_{LD}$, wherein $Y_{LD}$ is power load impedance, is dynamically maintained below the loci for maximum power transfer, $n^2Y_{LD}Z_{LN}=1$, wherein $Y_{LD}$ is power load impedance, $Z_{LN}$ is transmission line impedance and n is transformer ratio, preferably $Y_{LD}$ is maintained at a stable equilibrium.

The present invention makes use of a mathematical model:

For ease of reference a list of used variables is compiled below:

$\tilde{Z}_{LD}=Z_{LD}e^{j\Phi}$—load impedance, $\tilde{Y}_{LD}=1/\tilde{Z}_{LD}$—load admittance, $\tilde{Z}_{LN}=Z_{LN}\,e^{j\Theta}$—transmission line impedance, $\tilde{E}_s=E_s\,e^{j0}$—generator voltage, $\tilde{V}_1$—voltage on the primary side of the transformer, $\tilde{V}_2$—voltage on the secondary side of the transformer, n—transformator ratio, $V_{ref}$—reference voltage, $\tilde{I}_1$—current in the primary winding of the transformer, $\tilde{I}_2$—current in the secondary winding of the transformer For the system in FIG. 1, some basic relations can be stated [4]:

$$\tilde{V}_2/\tilde{V}_1=\tilde{I}_1/\tilde{I}_2=n$$

$$\tilde{E}_s=\tilde{I}_1\tilde{Z}_{ln}+\tilde{V}_1=\tilde{I}_2\left(n\tilde{Z}_{ln}+1/n\tilde{Z}_{LD}\right)$$

$$P_R=\left|\tilde{I}_2^2\tilde{Z}_{LD}\right|\cos\Phi=E_s^2\frac{Z_{LD}/n^2}{\left|\tilde{Z}_{ln}+\tilde{Z}_{LD}/n^2\right|^2}\cos\Phi$$

$$V_2=\left|\tilde{I}_2\tilde{Z}_{LD}\right|=E_s\frac{Z_{LD}/n}{\left|\tilde{Z}_{ln}+\tilde{Z}_{LD}/n^2\right|^2}$$

The function is a nonlinear function that determines the typical dependence of the active power on the line and load impedance (FIG. 2). Initially, for increasing $Y_{LD}$, the active power will increase. However, after a certain load admittance the transferred active power starts to decrease. For $Z_{LD}/n^2=Z_{ln}$ a maximum active power will be transmitted through the line.

Then for a constant active power load, a suitable model is:

$$\dot{Y}_{LD}=P_{ref}-P_R=P_{ref}-E_s^2\frac{Z_{LD}/n^2}{\left|\tilde{Z}_{ln}+\tilde{Z}_{LD}/n^2\right|}\cos\Phi \tag{1}$$

while the OLTC can be approximated by an integrator:

$$\dot{n}=V_{ref}-E_s\frac{Z_{LD}/n}{\left|\tilde{Z}_{ln}+\tilde{Z}_{LD}/n^2\right|} \tag{2}$$

In order to understand the behavior of the proposed model, consider first the dynamical system in equation (1). Due to the built-in non-linearity, the system can have two equilibrium points corresponding the reference active power (see FIG. 2). It can be shown that the one to the left of the peak is stable while the other is unstable. This will determine the typical behavior of a power system. After achieving the maximum value of the transferred active power, if the load admittance continues to increase, the system enters the unstable region. This will lead to instability if the load admittance achieves the value corresponding to the unstable equilibrium point.

Simulation results for the above model are shown in FIG. 3. The variable in the plot are the maximum transferable active power, the transferred active power and load impedance. In this scenario the load is trying to absorb an active power of 0.7 (dashed line). The initial value for the line impedance is 1. At t=75 a fault is simulated in the line by changing its impedance to 1.5. As shown in the first sub-plot, this implies that the maximum power that can be transferred through the line will drop just below 0.7. The load tries to absorb the desired active power by reducing its impedance (see the second and third sub-plot). However since that power is not achievable, the system will end up in instability and voltage collapse.

Considering both equations (1) and (2) in the model, similar qualitative behavior is retain as for the scalar case. FIG. 4 shows the vector field near the equilibrium points (marked with asterisks). The dashed line is given by the curve $n^2Y_{LD}Z_{ln}=1$, i.e. the loci of maximum power transfer (this happens if the line impedance and the load impedance are equal). Notice the unstable behavior to the right of this curve.

The present mathematical model is able to capture two instability scenarios.

1. The first case is shown in FIG. 3, where due to some fault in the transmission line the system is no longer able to transfer the requested active power. This corresponds to the situation when the system has no real equilibrium points. This is the classical case, which can be analyzed even with static methods.
2. Another instability scenario is when a stable equilibrium point exists, but where the system ends up in instability due to some transients. In FIG. 6, at 50 time units, a fault in the transmission line is simulated by a step increase of the line impedance. This step is such that a stable equilibrium point still exists, that is, the network should be able to transfer the requested active power. However, due to the fact that the operating point is close to the maximum transferable active power, an overshoot in $Yn^2$, will drive the system in the unstable region and the voltage will collapse.

The methods described in this paper adds stability margins so that the risk of the second scenario is significantly reduced. The stabilizing property of the methods will also help restoring stability after an overload condition when load shedding has been applied.

The proposed methods comes in before the methods 1 and 2 above would be applied. This way, adds no inconvenience to the customers while preserving stability. If stability cannot be maintained in spite of these methods (due to too large power demands), the methods above should be applied.

As can be seen in FIG. 4, it is desirable to move the system away from the unstable region above the stability limit (dashed curve). Since the load dynamics cannot be changed (except by load shedding), we suggest to momentarily alter the transformer ratio n so as to avoid the unstable region.

The following sections describe how this can be done in practice, indirectly, by changing the voltage reference $V_{ref}$ given to the standard OLTC.

A block diagram over the structure of the proposed compensator is shown in FIG. 7.

The compensator consists of two susbsystems. The first susbsystems consists of a feed-forward compensator and the second consists of a feedback controller.

The goal of the feed-forward compensation is to improve the convergence ratio of the system in case of a fault in the transmission line. In other words, the compensator will drive the system to the stable equilibrium point in case of a line fault. However, this method works only if, after the fault the system is still the stable region (i.e. $n^2Y_{LD}Z_{ln}<1$).

The idea of using such compensation is suggested by the structure of the presented simplified model. It is rather straightforward to show that the line impedance $Z_{ln}$ acts as a load disturbance on the system, similarly to $P_{ref}$. In addition, the line impedance can be considered measurable. It is natural then to use a feed-forward compensation from the line impedance in order to diminish the influence of line faults. If the transformer ratio n would be directly accessible for control purposes, the transient influence of line fault could be (at least theoretically) completely removed. Although only $V_{ref}$ is accessible, it is still possible to considerably improve the line-fault behavior of the system.

This compensating subsystem aims to prevent the grid from entering an unstable operating regime. For this it uses information about the line impedance.

A suitable feedforward compensation is given by the first order filter $$H_{ff}(s) = \frac{sT_d}{sT+1}$$

where T, $T_d$ are tuning parameters.

In case the system enters the unstable region (i.e. $n^2Y_{LD}Z_{ln}>1$), another control strategy has to be applied, which is described in the next section.

When the system is in the unstable region, it is desirable to drive it back to the stable operation regime. This can be done by reducing the reference voltage as long as the system is in the unstable region. Such a compensation can be achieved by a static nonlinear feedback. In FIG. 4, as a result of the compensation, the vector field above the line $n^2Y_{LD}Z_{ln}=1$ will point inwards (see FIG. 5). It can be seen in the plots that the region of attraction for the stable equilibrium point has been considerably increased.

It is to be mentioned here that the idea of using the distance from the peak of the function $f$ in voltage stability studies has been recently proposed in [3]. However, it has never been used (to the best of the authors knowledge) for dynamic compensation of the voltage reference signal.

Thus the second control subsystem aims to drive the grid from the unstable operation regime to the stable operation regime. For this it uses information about the line impedance, load impedance, and transformer ratio.

A suitable feedback controller is:

$$V_{fb}=-\max(0,\alpha(n^2Y_{LD}-1/Z_{ln}))$$

where $\alpha$ is a tuning parameter that is influencing the region of attraction of the equilibrium point.

In order to obtain more realistic simulation results the initial design model has been modified as follows:

- the dynamics have been scaled according to the benchmark model [5],
- additional dynamics have been introduced for the load argument, $\phi$,
- load shedding input k has been added,
- saturation and quantization is introduced on the transformer ration n. The latter is intended to simulate the mechanical tap-changer,
- since the tap-changer is inherently a discrete system, a discrete time representation of the OLTC dynamics is used. Notice that the tap-changer can make only one step at the time.
- in order to avoid chattering, an OLTC system usually contains a dead-zone on the control error.

This way the simulation model is the following:

$$\dot{Y} = 1\Big/T\left((1-k)P_{ref} - E_s^2\frac{Z_{LD}/n^2}{\left|\tilde{Z}_{ln}+\tilde{Z}_{LD}/n^2\right|^2}\cos\Phi\right)$$

$$\Phi = (1-k)Q_{ref} - 1/T\Phi - E_s^2\frac{Z_{LD}/n^2}{\left|\tilde{Z}_{ln}+\tilde{Z}_{LD}/n^2\right|^2}\sin\Phi$$

$$\eta(t+h) = \eta(t) + q\,\mathrm{sign}(e(t))$$

$$e(t) = dzn\left(V_{ref} - E_s\frac{Z_{LD}/n^2}{\left|\tilde{Z}_{ln}+\tilde{Z}_{LD}/n^2\right|}\right)$$

$$n = sat(\eta)$$

The saturation on n has the limits $n_{min}=0.75$, $n_{max}=1.25$, and the dead-zone has the limits ±0.03. The chosen quantization step q is 0.027. The chosen sampling time is 30 seconds, which approximates the mechanical delay of the tap-changer and the OLTC delay timer.

The three-stage control system consists of the following compensator:

feed-forward compensation:

$$H_{ff}(s) = \frac{30s}{20s+1}$$

has a "dirty-derivative" character with the low-pass filter having its time constant comparable with that of the controlled system.

feedback compensation:

$V_{fb}=-\max(0,\alpha(n^2Y_{LD}-1/Z_{ln}))$. The parameter $\alpha$ influences the region of attraction of the equilibrium point. In the simulations $\alpha=1.1$.

The first two control signals (and) augment the reference value as follows:

$$e(t) = dzn\left(V_{ref} + V_{ff} + V_{fb} - E_s\frac{Z_{LD}/n}{\left|\tilde{Z}_{ln}+\tilde{Z}_{LD}/n^2\right|}\right)$$

where dzn is the dead-zone function.

However, a more complex augmentation is also possible, e.g. $V_{ff}$ is conditioned by $V_{fb}$.

In the simulations, the following parameters have been used:

$V_{ref}=1.1$, $P_{ref}=0.78$, $E_s=1.5$, T=60, and $\theta=1.47$ radians. In addition, in the first simulation scenario (FIG. 8) the reference reactive power is $Q_{ref}=0.16$. The scenario consists of a line tripping at t=800 seconds, when the line impedance $Z_{ln}$ is increased from 1 to 1.2. The first 800 seconds in the simulations represent the initial transient to the studied equilibrium point and it has no physical interpretation. At the moment of the fault, $V_{ff}$ shows a significant increase. However, since the new equilibrium point is not achieved the system ends up in the unstable operating region (at around 1100 seconds). This will trigger the second stage of the controller, decreasing $V_{fb}$. This will result in a decrease of the overall voltage reference value such that the system is brought back in the stable region. Notice that throughout the entire control sequence, the third control stage (load shedding) is not engaged, i.e. k=0.

It is important to remark that the first step (i.e. $V_{ff}$) is sensitive to the fault timing due to the low sampling frequency. Similarly if multiple steps (e.g. two) would be possible, the performance would increase significantly. Nevertheless, even in the case of the state-of-the-art OLTCs, where the delay timer is inverse proportional to the control error, considerable improvements can be obtained in compensating for line tripping.

REFERENCES

[1] Miroslav Begovic and Damir Novosel. A novel method for voltage instability protection. In *Proceedings of the 35th Hawaii Internation Conference on System Sciences,* 2002.

[2] Miroslav Begovic, Damir Novosel, and Mile Milisavljevic. Trends in power system protection and control. In *Decision Support Systems* 30, pages 269-278, 2001.

[3] D. E. Julian, R. P. Schulz, K. T. Vu, W. H. Quaintance, N. B. Bhatt, and D. Novosel. Quantifying proximity to voltage collapse using the voltage instability predictor (vip). In *Power Engineering Society Summer Meeting, IEEE,* 2000.

[4] Prabha Kundur. *Power System Stability and Control.* McGraw-Hill, Inc., 1993.

[5] Mats Larsson. A simple test system illustrating load-voltage dynamics in power systems. In http://www.dii.unisi.it/hybrid/cc/.

[6] Khoi Tien Vu and Damir Novosel. Voltage instability predictor (VIP)—method and system for performing adaptive control to improve voltage stability in power systems. In U.S. Pat. No. 6,219,591 B1, 2001.

The invention claimed is:

1. A method for voltage stabilization of an electrical power network system comprising a producing power network system side and a consuming power network side comprising a transformer, a power transmission line with an impedance (ZLN) connected to a primary side of the transformer, a power load connected to a secondary side of the transformer, and an on-line tap changer added to the transformer, wherein a transformer ratio n is controlled through the on-line tap changer trying to keep the voltage (V2) on the secondary side of the transformer at a voltage reference (Vref) the method comprising: measuring the impedance of the line in case of dynamic instabilities; and changing the controlling a transformer ratio n by changing a voltage reference (Vref) of the on-line tap changer, according to a feed forward compensation from the impedance of the line.

2. The method according to claim 1, wherein the feed forward compensation drives the power network system to a stable equilibrium point in a stable region, and wherein the stable region lies below a loci for maximum power transfer $n^2Y_{LD}Z_{LN}=1$, where $Y_{LD}$ is power load admittance, $Z_{LN}$ is transmission line impedance and n is the transformer ratio.

3. The method according to claim 1, wherein the feed forward compensation is provided by a first order filter $H_{ff}(s)=sT_d/(sT+1)$, where T and $T_d$ are tuning parameters.

4. The method according to claim 1, wherein a feedback controller is provided according to an equation $Vfb=-\max(0,a(n^2Y_{LD}-1/Z_{LN})$, where n is the transformer rato, $Y_{LD}$ is power load admittance, $Z_{LN}$ is transmission line impedance and a is a tuning parameter that is influencing a region of attraction of an equilibrium point.

* * * * *